United States Patent [19]

Maruyama

[11] Patent Number: 4,974,026

[45] Date of Patent: Nov. 27, 1990

[54] REVERSE DEVELOPMENT ELECTROPHOTOGRAPHIC APPARATUS AND IMAGE FORMING METHOD USING A DISPERSION-TYPE ORGANIC PHOTOCONDUCTOR

[75] Inventor: Akio Maruyama, Tokyo, Japan

[73] Assignee: Canon Kabushiki Kaisha, Tokyo, Japan

[21] Appl. No.: 222,406

[22] Filed: Jul. 21, 1988

[30] Foreign Application Priority Data

Jul. 28, 1987 [JP] Japan ..... 62-186642

[51] Int. Cl.[5] ..... G03G 15/00

[52] U.S. Cl. ..... 355/246; 355/221

[58] Field of Search ..... 355/219, 221, 225, 223, 355/245, 246, 214

[56] References Cited

U.S. PATENT DOCUMENTS

| | | | |
|---|---|---|---|
| 4,200,387 | 4/1980 | Masumura | 355/3 DD |
| 4,248,524 | 3/1981 | Takahashi | 355/14 E |
| 4,511,240 | 4/1985 | Suzuki et al. | 355/243 X |
| 4,780,744 | 10/1988 | Porter et al. | 355/214 X |

FOREIGN PATENT DOCUMENTS 60-249166 12/1985 Japan .

*Primary Examiner*—R. L. Moses

*Attorney, Agent, or Firm*—Fitzpatrick, Cella, Harper & Scinto

[57] ABSTRACT

An electrophotographic apparatus comprising a photosensitive member, charging means for providing a surface potential to the surface of the photosensitive member, image exposure means for exposing the photosensitive member to form an electrostatic latent image which comprises an unexposed dark part and a exposed light part, developing means including a developer-carrying member for providing a toner to the light part thereby to develop the latent image with the toner and bias application means for applying a bias voltage between the developer-carrying member and the photosensitive member surface to control a developing condition; the apparatus further comprising image regulation means for changing the surface potential in the dark part (Vd) in association with the change in DC component ($V_{DC}$) of the bias voltage.

13 Claims, 4 Drawing Sheets

REVERSE DEVELOPMENT ELECTROPHOTOGRAPHIC APPARATUS AND IMAGE FORMING METHOD USING A DISPERSION-TYPE ORGANIC PHOTOCONDUCTOR

FIELD OF THE INVENTION AND RELATED ART

The present invention relates to an electrophotographic apparatus using reversal development, particularly to an electrophotographic apparatus including an image regulation means for changing a dark part potential on an electrophotographic photosensitive member in association with a change in the DC component of a bias voltage for controlling a developing condition.

In an electrophotographic process, the surface of an electrophotographic photosensitive member is repeatedly subjected to charging, image exposure, developing and cleaning operations.

In order to stabilize a charging potential on an electrophotographic photosensitive member in repetitive use, there has been proposed and practically used a device that a grid electrode is disposed between the photosensitive member and a charger. Further, with respect to the developing process, various methods have practically been used. Among these, one wherein a bias voltage is applied between an electrophotographic photosensitive member and a developer (toner)-carrying member is an extremely excellent developing method in view of image clearness, easiness in control, etc.

Generally speaking, the principle in development using a toner is such that charged toner particles disposed on a developer-carrying member are attached to an electrophotographic photosensitive member bearing an electrostatic latent image corresponding to the latent image by an electric attractive force exerted between the photosensitive member and the developer-carrying member, thereby to form a toner image. The above-mentioned application of a bias voltage between the photosensitive member and the developer-carrying member has enabled the control of the electric attraction between the photosensitive member and the developer-carrying member, and has further enabled the control of image density, resolution and clearness of the resultant image.

On the other hand, the methods of developing an electrostatic latent image formed on an electrophotographic photosensitive member are roughly classified into two types, i.e., the normal development method and the reversal development method. In normal development, toner particles are attached to a portion of a photosensitive member not supplied with image exposure or supplied with a relatively small quantity of light, i.e., a portion thereof having a higher absolute value of surface potential. On the contrary, in the reversal development method, toner particles are attached to a portion of the photosensitive member having a lower absolute value of surface potential. Accordingly, in reversal development, toner particles having the same polarity as that of primary charging are used for the development.

Conventionally, the above-mentioned normal development method has commonly been used. On the other hand, the reversal development method has recently been used in a printer for microfilm or an electrophotographic printer (laser printer) using a laser beam as a light source.

As apparent from the above description, in a case where the development using a toner is effected by utilizing electric attraction, the triboelectric charge (amount) of the toner is an extremely important factor. The triboelectric charge of the toner is generally produced by triboelectrification based on rubbing, but it is very difficult to orient the triboelectric charges of respective toner particles to a single polarity, i.e., to cause all the toner particles to have triboelectric charges with positive (or negative) polarity. Practically, toner particles having triboelectric charges with opposite polarity are necessarily present, although the number thereof is small.

Now, in the reversal development method, there is a condition for development such that a dark part surface potential Vd, a light part potential Ve and a developing bias $V_{DC}$ satisfy a relationship of $|Vd| > |V_{DC}| > Ve$, and Vd, $V_{DC}$, Ve and the triboelectric charge of the toner have the same polarity. For example, when Vd is negative, toner particles having negative triboelectric charge are used, and the toner particles are attached to a portion having the light part potential Ve under electric attraction based on the potential difference between $V_{DC}$ and Ve.

However, as described above, some toner particles having positive triboelectric charges are present in those having negative triboelectric charges. Accordingly, when the difference between Vd and $V_{DC}$ is relatively large, the above-mentioned toner particles having positive triboelectric charges are attached to a dark part of an electrophotographic photosensitive member having Vd (hereinafter, such phenomenon is referred to as "reverse fog"). When such toner particles are transferred to transfer paper, there occurs soiling on a white background. Even when such toner particles are not transferred to the transfer paper, the toner consumption per one sheet of copy is remarkably increased thereby to raise the cost per one sheet of copy.

In the conventional image regulation method, only $V_{DC}$ is changed while Vd is kept constant, whereby image density, resolution, clearness, etc., of the resultant image are changed. In this method, the amount or degree of the above-mentioned reverse fog is changed depending on the change in $V_{DC}$. Particularly, when the difference between Vd and $V_{DC}$ is increased by decreasing the absolute value of $V_{DC}$, soiling on a white background and a considerable increase in toner consumption has been serious problems.

On the other hand, such electrophotographic apparatus have used photosensitive members such as selenium-type, selenium alloy-type, cadmium sulfide-resin dispersion-type, amorphous silicon-type, organic photoconductor (OPC)-type, etc. Among these, the organic photoconductor-type photosensitive member has recently attracted much attention because of various advantages that it has high productivity and is low in production cost, and that the sensitive wavelength region thereof may arbitrarily be controlled by selecting a compound to be used therein. Accordingly, the organic photoconductor-type photosensitive members have practically been used widely. Among these, particularly, a laminate-type photosensitive member obtained by function-separating the photosensitive layer thereof into a charge generation layer and a charge transport layer is more advantageous than another one-layer type photosensitive member in view of sensitivity and an increase in residual potential after a successive copying test. The photosensitive layer of the laminate-type photosensitive member is obtained by laminating a charge transport layer predominantly comprising a charge-transporting substance and a charge generation layer predominantly comprising a charge-generating substance.

In the laminate-type photosensitive member, the charge generation layer generally comprises, as the charge-generating substance, organic pigments such as phthalocyanine pigments, dibenzpyrene pigments, trisazo pigments, bisazo pigments and azo pigments. The charge generation layer may be formed by applying the charge-generating substance, together with a charge-transporting substance and an appropriate binder as desired, onto a substrate. Incidentally, the binder is omissible in this case.

Further, the charge generation layer may be formed on a substrate as a vapor-deposition layer by using a vapor-depositing device, but the above-mentioned coating method is mainly used at present in view of productivity.

However, in a case where a charge generation layer is formed by dispersing an organic pigment as a charge-generating substance and applying the resultant dispersion onto a substrate, a charge injection point is locally formed on the surface of the resultant coating because of ununiformity in the particle size of the dispersed particles, aggregation or agglomeration of the pigment particles caused in the coating step, etc. When a dark part potential is locally decreased due to the charge injection point, a relatively large portion in which the dark part potential is locally decreased is formed in the periphery of the charge injection point. As a result, when a copied image is formed by using an electrophotographic photosensitive member having such charge generation layer, the above-mentioned charge injection point appears as an image defect. Particularly, in a case where such photosensitive member is used in an electrophotographic apparatus such as copying machine and printer for effecting reversal development, the above-mentioned charge injection point has a lower surface potential than that in the other dark part, whereby toner particles are liable to be attached to this point. As a result, an image defect in the form of a black spot is liable to occur.

Further, in a case where Vd is kept constant and $V_{DC}$ is changed according to the conventional image regulation method, when the absolute value of $V_{DC}$ is increased in order to enhance the image density, many image defects of the above-mentioned black spots occur. As a result, such image defect has been a serious problem in the conventional image regulation method.

SUMMARY OF THE INVENTION

An object of the present invention is to provide an electrophotographic apparatus using reversal development, and an image forming method which have solved the above-mentioned problems.

A specific object of the present invention is to provide an electrophotographic apparatus which includes a function-separated photosensitive member comprising a charge transport layer and a charge generation layer comprising a charge-generating substance, and has an image regulation means capable of providing an image without reverse fog or image defect in the whole regulation range.

According to the present invention, there is provided an electrophotographic apparatus comprising: a photosensitive member, charging means for providing a surface potential to the surface of the photosensitive member, image exposure means for exposing the photosensitive member to form an electrostatic latent image which comprises an unexposed dark part and an exposed light part, developing means including a developer-carrying member for providing a toner to the light part thereby to develop the latent image with the toner, and bias application means for applying a bias voltage between the developer-carrying member and the photosensitive member surface to control a developing condition; the charging means, image exposure means, and developing means being disposed in this order along the moving direction of the photosensitive member; the apparatus further comprising image regulation means for changing the surface potential in the dark part (Vd) in association with the change in DC component ($V_{DC}$) of the bias voltage.

The present invention also provides an image forming method, comprising:

charging a photosensitive member to provide a surface potential thereto, exposing the photosensitive member imagewise to form thereon an electrostatic latent image which comprises an unexposed dark part and an exposed light part, providing a toner from a developer-carrying member to the light part thereby to develop the latent image with the toner;

wherein a bias voltage is applied between the developer-carrying member and the photosensitive member surface to control a developing condition, and the surface potential in the dark part (Vd) is changed in association with the change in DC component ($V_{DC}$) of the bias voltage.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 3–6 are graphs respectively showing relationships between various parameters in a laminate-type photosensitive member obtained by coating; wherein FIG. 3 shows a relationship between the average particle size of a charge-generating substance and a surface potential decrease in a dark part; FIG. 4 shows a relationship between the thickness of a charge generation layer and a surface potential decrease in a dark part; FIG. 5 shows a relationship between the average particle size of a charge-generating substance and the number of image defects; and FIG. 6 shows a relationship between the thickness of a charge generation layer and the number of image defects.

DETAILED DESCRIPTION OF THE INVENTION

Figure 2:
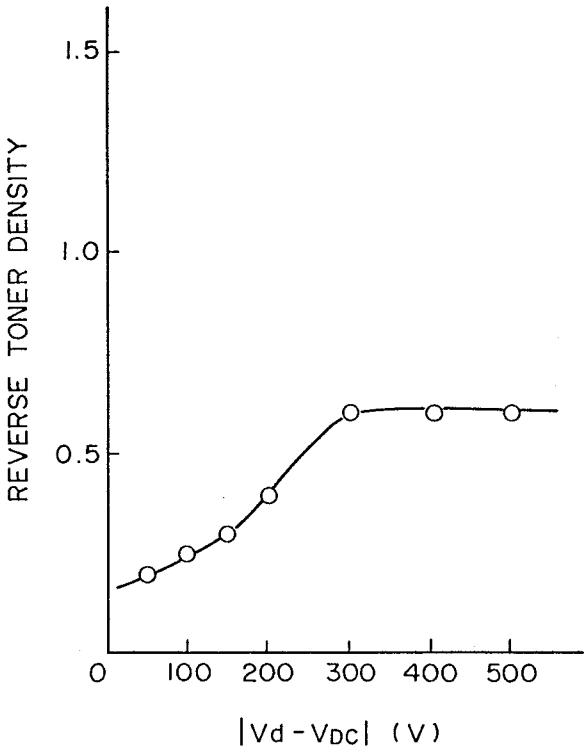
FIG. 2, is a graph showing a relationship between the difference between a dark part potential Vd and a developing bias $V_{DC}$, and a reverse-toner density.
Figure 1:
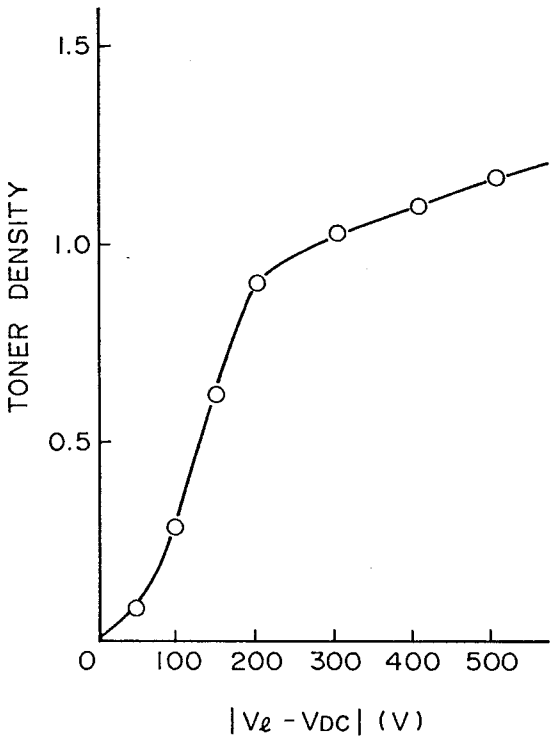
FIG. 1 is a graph showing a relationship between the difference between a light part potential Ve and a developing bias $V_{DC}$, and a toner density in an electrophotographic apparatus utilizing a reversal development method.

First, the relationships between an image and Vd, Ve and $V_{DC}$ values are specifically described with respect to an electrophotographic apparatus adopting a reversal development method (or system), while referring to FIGS. 1 and 2.

According to my detailed experiment, the above-mentioned relationships are as follows.

By using an electrophotographic apparatus (LBP-CX, mfd. by Canon K.K.), the relationship between an image density and the potential difference between $V_{DC}$ and Ve was determined.

More specifically, a toner image was formed on an electrophotographic photosensitive member according to the reversal development method and was transferred to paper by using the above-mentioned electrophotographic apparatus. Then, the density of a toner transferred to a portion of the paper corresponding to a light part of the photosensitive member was measured by means of a Macbeth densitometer, (Macbeth RD-514) thereby to determine an image density.

The thus obtained results are shown in FIG. 1. As shown in FIG. 1, the image density becomes larger as the potential difference $|Ve-V_{DC}|$ becomes larger. Accordingly, $V_{DC}$ or Ve may be changed in order to regulate the image density.

Then, by using the above-mentioned electrophotographic apparatus, a toner image was formed on paper in the same manner as described above. Then, the density of a toner transferred to a portion of the paper corresponding to a dark part of the photosensitive member was measured by means of the Macbeth densitometer, thereby to determine a reverse-toner density.

The thus obtained results are shown in FIG. 2. As described above, the degree of the reverse fog (i.e., reverse-toner density) depends on the potential difference between Vd and $V_{DC}$. In the above-mentioned electrophotographic apparatus, as shown in FIG. 2, the reverse toner density becomes larger as the potential difference between Vd and $V_{DC}$ becomes larger.

In a case where image regulation is effected by changing $V_{DC}$, when Vd is constant, the reverse fog may be increased if $|V_{DC}|$ is decreased. In the above-mentioned electrophotographic apparatus, Vd is set to −700V, Ve is set to −150V, and $V_{DC}$ has a middle value of −450V and an image regulation range (i.e., a variation range) of ±50V. As shown in FIG. 2, in the range of $|Vd-V_{DC}|$ of from 200V to 300V, the degree of the reverse fog sharply changes.

Thus, the first object of the present invention is to always suppress the reverse fog to a small extent in the image regulation range of $V_{DC}$. For this purpose, Vd may be changed in association with a change in $V_{DC}$.

In the present invention, the change in $V_{DC}$ may occur simultaneously with that in Vd. Alternatively, there may be a certain interval of time between the changes in $V_{DC}$ and Vd.

In the present invention, an increase or decrease in $V_{DC}$ may preferably correspond to an increase or decrease in vd, respectively. For example, Vd may preferably be changed simultaneously with a change in $V_{DC}$, by an amount equal to that of the $V_{DC}$ change, or by an amount obtained by multiplying that of the $V_{DC}$ change and a certain factor. More specifically, in the present invention, $V_{DC}$ and Vd may preferably satisfy the following formula:

$$|Vd-Vd^o|=A\times(|V_{DC}-V_{DC}^o|)^n,$$

wherein $|V_{DC}^o|$ is the minimum value in the variation range of $|V_{DC}|$ (i.e., the range in which $|V_{DC}|$ is variable), $Vd^o$ is the value of Vd corresponding to the $V_{DC}^o$, A is a multiplication factor, and all of the $Vd^o$, Vd, $V_{DC}^o$ and $V_{DC}$ have the same signs.

In the above formula, n may preferably be a real number of 1–2. Further, the multiplication factor A depends on how to control the Ve, and also depends on a developing method, the material of an electrophotographic photosensitive member, the material of a toner, etc. Accordingly, the optimum value of the above factor A varies depending on the combination of the above-mentioned conditions.

However, in general, in a case where n=1 (i.e., the amount of change in $V_{DC}$ is proportional to that in Vd), the factor A may preferably be 0.1–3. Further, in a case where n=2, the factor A may preferably be 0.001–0.1.

Hereinbelow, an embodiment of the electrophotographic apparatus according to the present invention will be described with reference to a schematic view of FIG. 7.

Figure 7:
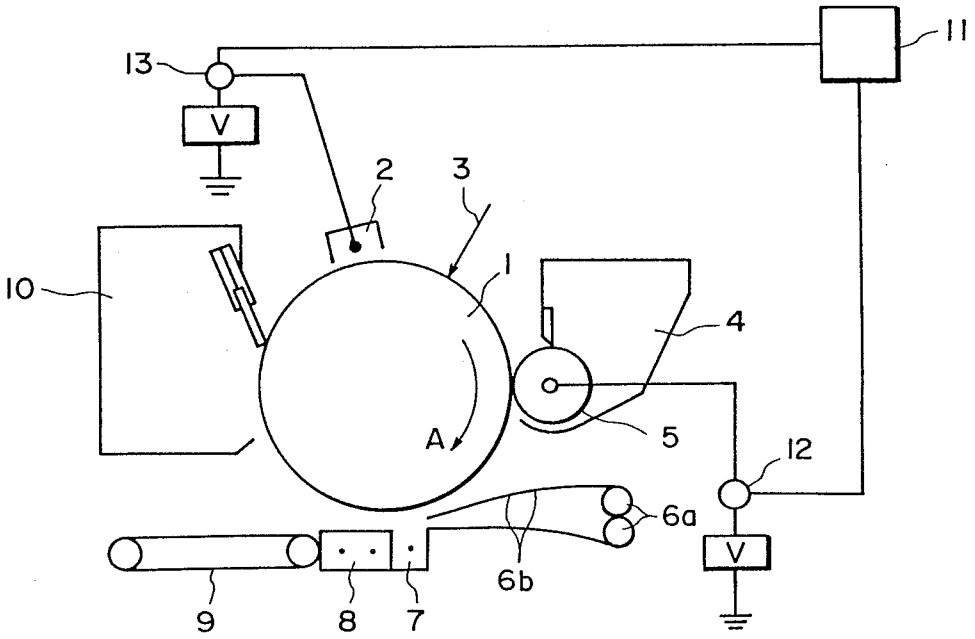
FIG. 7 is a schematic view of an embodiment of the electrophotographic apparatus according to the present invention.

Referring to FIG. 7, the electrophotographic apparatus comprises: a cylindrical photosensitive member 1, and around the photosensitive member 1, a primary charger 2 for charging the photosensitive member 1, an image exposure unit (not shown) for providing a light beam 3 (e.g. a laser beam) to form a latent image on the photosensitive member 1, a developing apparatus 4 having a developer (toner)-carrying member 5 for developing the latent image with a toner (not shown) to form a toner image, a feeder comprising a pair of feed rollers 6a and a guide 6b for supplying a transfer material such as paper (not shown), a transfer charger 7 for transferring the toner image from the photosensitive member 1 onto the transfer material, a separation charger 8 for separating the transfer material from the photosensitive member 1, a conveyor 9 for conveying the separated transfer material to a fixing apparatus (not shown), a cleaner 10 for removing a residual toner.

In the apparatus shown in FIG. 7, as desired, there may be disposed a light source for pre-exposure (not shown) between the cleaner 10 and the primary charger 2, and/or a pre-transfer exposure means (not shown) between the developing apparatus 4 and the transfer charger 7.

In operation, the photosensitive member 1 is rotated in the direction of an arrow A at a predetermined peripheral speed, and image formation is implemented according to a known electrophotographic image formation process.

In the electrophotographic apparatus according to the present invention as shown in FIG. 7, a voltage controller 13 (e.g., a variable resistor) for the primary charger 2, and a voltage controller 12 for the developer-carrying member 5 are connected to a density controller 11. The voltage controller 13 regulates a voltage applied to the primary charger corresponding to a change in the density controller 11. Similarly, the voltage controller 12 regulates a voltage applied to the developer carrying member 5. The interlock regulation of the voltages applied to the primary charger 2 and the developer-carrying member 5, which corresponds to the change in the density controller 11, may be effected by using either a mechanical method or microcomputer control. According to such arrangement, the dark part surface potential (Vd) applied to the electrophotographic photosensitive member 1 by charging, and the DC component ($V_{DC}$) of a bias applied to the developer-carrying member 5 may be changed simultaneously while retaining a predetermined relationship therebetween. In the present invention, the dark part potential (Vd) may be measured at a developing position at which the photosensitive member 1 confronts the developing apparatus 4, by means of a potential-measuring probe.

In this case, the DC component ($V_{DC}$) and the surface potential (Vd) may preferably be regulated so that the changes (i.e., increase or decrease) therein have the same signs (or directions), more preferably so that when the $V_{DC}$ is decreased, Vd is also decreased together with the decrease in $V_{DC}$.

$|V_{DC}|$ may generally be changed in the range of 700–150V, preferably 650–200V, particularly 600–400V. When the maximum value of $V_{DC}$ is represented by $V_{DC}^{max}$, the variation range of $|V_{DC}|$ (i.e., $|V_{DC}^{max}-V_{DC}^{o}|$) may preferably be 100–300V, particularly 150–250V.

$|Vd|$ may generally be 850–250V, preferably 750–550V, particularly preferably 720–600V. Further, when the maximum value of Vd is represented by $V_d^{max}$, the variation range of $|Vd|$ (i.e., $|V_d^{max}-V_d^{o}|$) may generally be 30–450V, preferably 40–200V, particularly 50–120V.

In view of the prevention of reverse fog, $|Vd-V_{DC}|$ may preferably be changed in the range of 100–300V, particularly 120–250V. Further, the variation range of $|Vd-V_{DC}|$ (i.e., $|Vd-V_{DC}|^{max}-|Vd-V_{DC}|^{min}$) may preferably be 180V or below, particularly 160V or below. $|Vd-V_{DC}|^{max}$ and $|Vd-V_{DC}|^{min}$ used herein respectively represent the maximum and minimum values of $|Vd-V_{DC}|$.

Representative examples of the charge-generating substance used in the present invention may include: phthalocyanine pigments, anthanthrone pigments; dibenzpyrene pigments, pyranthrone pigments, trisazo pigments, disazo pigments, azo pigments, indigo pigments, quinacridone pigments, etc. In addition, coloring matters such as pyrilium dyes, thiopyrylium dyes, xanthene compounds, quinoneimine compounds, triphenylmethane compounds and styrene-type compounds may be used after they are converted into pigments. These pigments may be used singly or as a mixture of two or more species.

The charge generation layer may be formed by applying the charge-generating substance onto a substrate, together with a charge-transporting substance and an appropriate binder as desired. In this case, the binder is omissible. The average particle size of the charge-generating substance in a dispersion, as a coating liquid for the charge generation layer, may preferably be 3 μm or smaller, more preferably 1 μm or smaller.

Formation of a charge generation layer may be practiced according to the coating method such as dip coating, spray coating, spinner coating, bead coating, wire bar coating, blade coating, roller coating, curtain coating, etc.

The charge transport layer is electrically connected to the above-mentioned charge generation layer and has functions of receiving charge carriers injected from the charge generation layer in the presence of an electric field, and of transporting these charge carriers. In this case, the charge transport layer may preferably be superposed on the charge generation layer.

The charge transport layer may be formed by vapor-depositing zinc oxide, selenium, a selenium alloy, amorphous silicon, etc., or by using an inorganic photoconductor such as zinc oxide, selenium powder and amorphous silicon powder sensitized by a coloring matter. Further, the charge transport layer may be formed by applying an organic charge-transporting substance such as hydrazone compounds, pyrazoline compounds, oxazole compounds, thiazole compounds, and triarylmethane compounds, together with a binder as desired.

The decrease in surface potential after charging in a dark part of an electrophotographic photosensitive member largely depends on the characteristic of a charge generation layer. More specifically, the injection of charge from a substrate to the charge generation layer, the amount of charge generated by heat in the charge generation layer, and the amount of photoelectric charge stored in the charge generation layer by pre-charging exposure closely relate to the coating condition of the charge generation layer.

Figure 4:
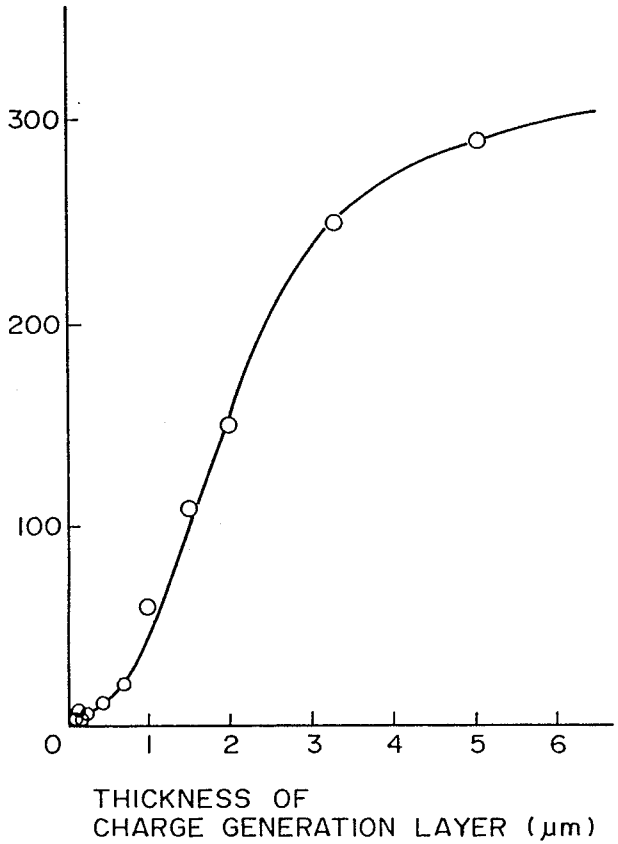
Figure 3:
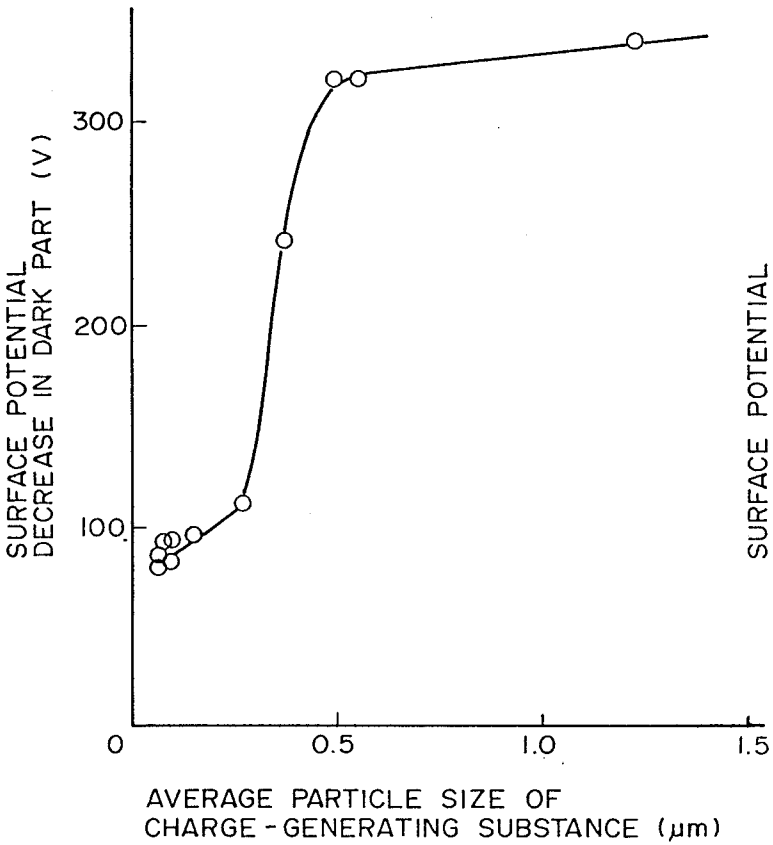

FIGS. 3 and 4 show relationships between a decrease in surface potential in a dark part, and the average particle size of a charge-generating substance and the thickness of a charge generation layer, respectively, in a case where ε-type copper phthalocyanine is used as the charge-generating substance. The decrease in surface potential is that in the dark part in one second after a photosensitive layer is charged to have an initial potential of −700V.

The relationships shown in FIGS. 3 and 4 were determined in the following manner.

First, 10 parts (parts by weight, the same in the description appearing hereinafter) of a copolymer nylon (trade name: Toresin, mfd. by Toray K.K.) was dissolved in a liquid mixture comprising 60 parts of methanol and 40 parts of butanol. The resultant solution was applied onto the surface of a thin aluminum plate by dip coating, thereby to form a 2.0 μm-thick intermediate layer of polyamide.

Then 1 part of ε-type copper phthalocyanine (trade name: Linol Blue FS, mfd. by Toyo Ink Seizo K.K.), and 1 part of a butyral resin (trade name: S-LED BM-2, mfd. by Sekisui Kagaku K.K.), and 10 parts of cyclohexanone were dispersed by means of a sand mill together with 50 parts of 1 mm-diameter glass beads. In this case, 13 species of dispersion liquids were prepared by changing the dispersing time from 0 min. to 20 hours. With respect to the thus prepared dispersions, the relationships between the dispersing time and the average particle size of the ε-type phthalocyanine are shown in the following Table 1.

TABLE 1

| Dispersing time (min.) | 0* | 1 | 5 | 10 | 30 | 60 | 120 | 180 | 300 | 420 | 600 | 900 | 1200 |
|---|---|---|---|---|---|---|---|---|---|---|---|---|---|
| Average particle size (μm) | 1.2 | 0.53 | 0.46 | 0.35 | 0.25 | 0.13 | 0.09 | 0.08 | 0.07 | 0.07 | 0.06 | 0.05 | 0.04 |

*The above-mentioned mixture was simply mixed with the glass beads and shaken.

The dispersions shown in Table 1 as coating liquids were applied onto the intermediate layer as formed above, and then dried at 100° C. for 5 min. to form 1.0 μm-thick charge generation layers, respectively.

Further, in order to obtain other samples, the above-mentioned dispersion corresponding to the dispersing time of 1200 min. as a coating liquid was applied onto the intermediate layer and dried in the same manner as described above to form 14 species of charge generation layers respectively having different thickness of 0.03, 0.05, 0.07, 0.1, 0.15, 0.2, 0.3, 0.4, 0.7, 1.0, 1.5, 2.0, 3.0 and 5.0 μm.

Then, 10 parts of a hydrazone compound represented by the following formula:

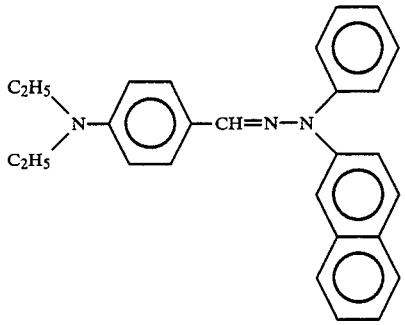

and 15 parts of a styrene-methyl methacrylate copolymer resin (trade name: MS-200, mfd. by Shin-Nichitetsu Kagaku K.K.) were dissolved in 90 parts of toluene to prepare a coating liquid, which was then applied onto the above-mentioned charge generation layer by dip coating. The resultant coating was left standing for 10 min., and thereafter dried under heating at 100° C. for 1 hour to form a 16 μm-thick charge transport layer, whereby a electrophotographic photosensitive member was prepared.

The thus prepared photosensitive member was charged by corona charging to have a saturated surface potential of −700 V, and the decrease in the surface potential in a dark part was measured with respect to a length of time of 1 sec. after the charging.

The thus obtained results are shown in FIGS. 3 and 4 wherein FIG. 3 shows a relationship between the average particle size of the charge-generating substance and the surface potential decrease, and FIG. 4 shows a relationship between the thickness of the charge generation layer and the surface potential decrease.

From these Figures, it is found that the decrease in surface potential in the dark part becomes larger, i.e., the injection amount of charge from the charge generation layer to charge transport layer in the dark part becomes larger, as the particle size of dispersed particles of the charge-generating substance becomes larger, or as the thickness of the charge generation layer becomes larger. While the ε-type copper phthalocyanine was used as the charge-generating substance in the above-mentioned embodiment, such phenomenon is not peculiar thereto. Even when another charge generation layer of an organic pigment-dispersion-type is used, a similar tendency is observed.

As described above, the injection amount of charge from the charge generation layer to charge transport layer in the dark part closely relates to the particle size of an organic pigment as the charge generating substance, and to the thickness of the charge generating layer. On the other hand, in the actual coating surface of an electrophotographic photosensitive member, the above-mentioned particle size and thickness microscopically have considerable unevenness and a wide distribution.

More specifically, as a means for dispersing an organic pigment, there are used roll mill, ball mill, vibrating ball mill, attritor, sand mill colloid mill, etc. If the average particle size of an organic pigment dispersed by such means becomes small, relatively large particles are necessarily present to some extent. Further, even if these larger particles are removed by filtration, etc., the average particle size of the pigment is liable to increase in the storage of the pigment dispersion because a pigment per se has an agglomerative property.

Further, at the time of coating, the organic pigment particles are liable to aggregate or agglomerate about nuclei such as scratches of a background, or dust or dirt thereon. As a result, relatively large particles are locally liable to be produced when a dispersion liquid state is converted into a coating film state. Further, with respect to the thickness of the charge generation layer, a locally thick portion is necessarily present therein, because of the smoothness of the background or the agglomeration of the organic pigment.

In the above-mentioned portion of the charge generation layer wherein the particle size of the pigment or the thickness is locally large, the injection of charge from the charge generation layer to charge transport layer is more remarkable than that in the other portion, as shown in FIGS. 3 and 4. Accordingly, in an electrophotographic photosensitive member having such uneven portions, there are present some portions, even in a dark part, wherein the absolute value of the surface potential is locally smaller than that of the other portion. Particularly, in an electrophotographic photosensitive member subjected to reversal development, such portion having a locally small absolute value of potential is provided with toner particles to be developed, whereby an image defect occurs.

Then, there is described an experiment for evaluating the number of such image defects.

The same photosensitive member sample as described above was assembled in the above-mentioned electrophotographic apparatus (LBP-CX, mfd. by Canon K.K.), and was subjected to image formation under conditions of 35° C. and 90% RH, whereby the number of image defects were evaluated. In this evaluation, a solid white image was formed under the conditions of Vd=700 V, Ve=100 V, and at the scale of $F_5$ (the middle value for image density regulation), and the number of image defects in the form of black spots having a diameter of 0.05 mm or above (i.e., black spot fog) was counted according to naked eye observation with respect to an area of 100 $cm^2$ of the image.

Figure 6:
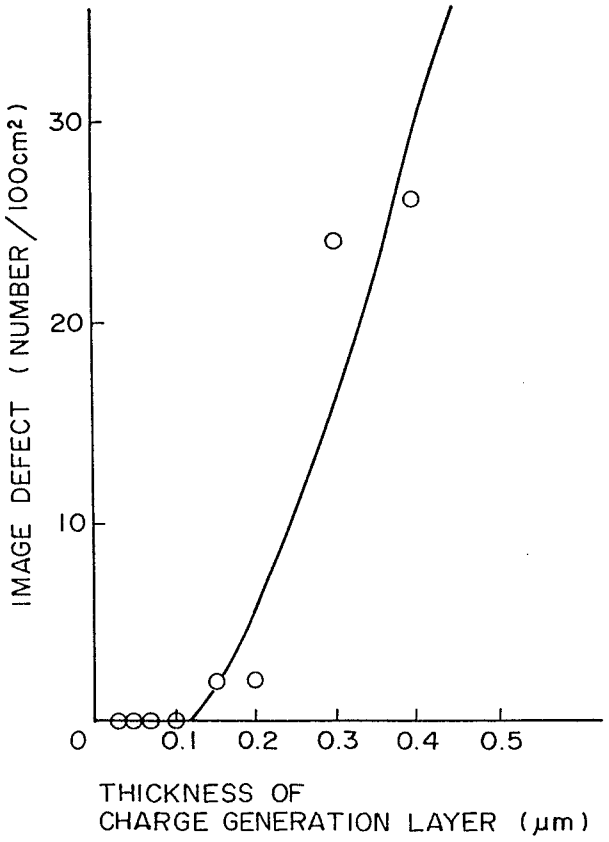
Figure 5:
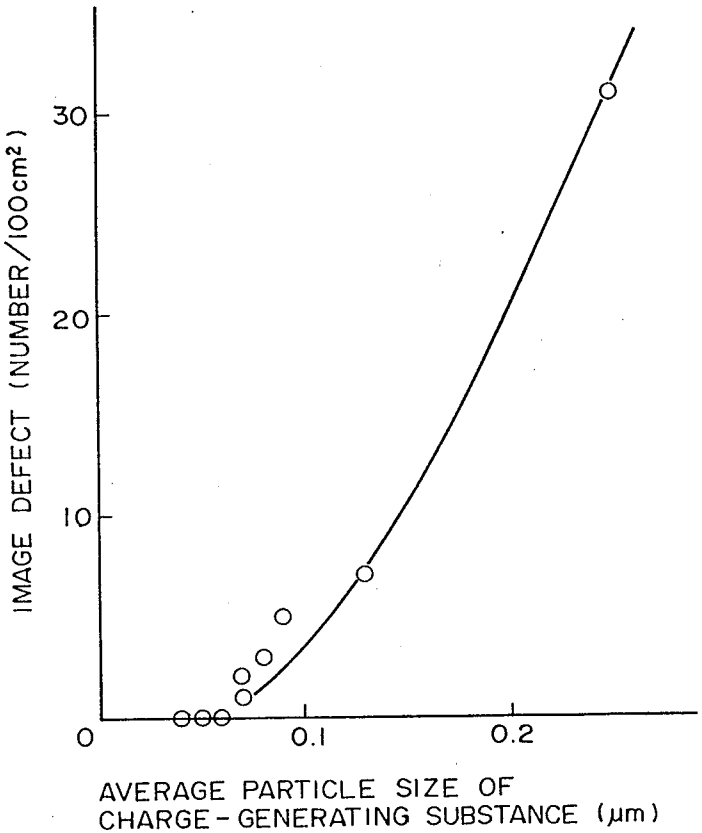

The thus obtained results are shown in FIGS. 5 and 6 wherein FIG. 5 shows a relationship between the average particle size of the pigment and the number of image defects, and FIG. 6 shows a relationship between the thickness of the charge generation layer and the number of image defects.

As apparent from these Figures, in an electrophotographic photosensitive member wherein a pigment as an organic photoconductor is contained in a charge generation layer by using a coating method, the probability of the occurrence of the image defect sharply increases corresponding to an average particle size of the pigment of 0.07 μm or above, and corresponding to the thickness of the charge generation layer of 0.1 μm or above.

Thus, the second object of the present invention is to prevent the occurrence of image defect. This object is attained by changing $V_{DC}$ simultaneously with Vd.

According to the present invention, the abovementioned image defect may be prevented even if the average particle size of a charge generation layer such as an organic pigment is 0.07 μm or above, or the thickness of a charge generation layer is 0.1 μm or above. Such relatively large particle size of the charge generation layer or relatively large thickness of the charge generation layer is advantageous in view of productivity (e.g., dispersing time for the charge-generating substance), or easiness in production of a photosensitive member.

The particle size used herein may be measured by means of an automatic centrifugal device for measuring a particle size distribution (CAPA 700, mfd. by Horiba Seisakusho K.K.) which is based on the liquid phase sedimentation method. Further, the thickness of the charge generation layer used herein may be measured by means of a device for measuring thickness of a thin film (mfd. by KETT Co.) which utilizes an eddy current.

The electrophotographic apparatus of the present invention may be either a digital-type or an analog-type. However, the digital-type is advantageous because it may suitably use a charge-generating substance having a relatively large particle size.

As described above, the image defect is based on the presence of a portion of a photosensitive member wherein the decrease in surface potential in a dark part is locally large. Accordingly, when the potential difference between Vd and $V_{DC}$ is caused to be sufficiently large, the occurrence of the image defect may be prevented.

When image regulation is effected by changing $V_{DC}$, Vd may also be changed in synchronism with the change in $V_{DC}$ so that the difference between Vd and $V_{DC}$ is retained so as not to cause an image defect. In a case where Vd and $V_{DC}$ are controlled so that $\Delta V_{DC}$ has a proportional relationship with ΔVd, as described above with respect to the reverse fog, e.g., $V_{DC}$ and Vd may preferably satisfy the following formula:

$$|Vd - Vd^0| = A \times |V_{DC} - V_{DC}^0|,$$

wherein all of the $Vd^0$, Vd, $V_{DC}^O$ and $V_{DC}$ have the same signs.

Incidentally, in a laminate-type photosensitive member of which charge generation layer comprises an organic photoconductor, the above-mentioned multiplication factor A may preferably be 0.5–3.0, more preferably 0.5–2.0.

Hereinbelow, the present invention will be explained in more detail with reference to Examples.

EXAMPLE 1, COMPARATIVE EXAMPLE 1

A substrate in the form of an aluminum cylinder having a bottom portion was prepared according to a drawing method as disclosed in Japanese Laid-Open Patent Application (JP-A, KOKAI) No. 10950/1984. The cylindrical portion of the thus prepared aluminum cylinder had an average diameter of 60 mm, an average wall thickness of 0.5 mm and a length of 260 mm.

First, an ammoniacal aqueous solution of casein (casein: 11.2 g, 28% aqueous solution of ammonia: 1 g, and water: 222 ml) was applied onto the above substrate by dip coating and then dried to form an undercoat layer in a coating amount of 1.0 g/m².

Then 1 part of τ-type copper phthalocyanine (mfd. by Toyo Ink Seizo K.K.) as a charge-generating substance, and a butyral resin (trade name: S-LEC BM-2, mfd. by Sekisui Kagaku K.K.), and 10 parts of cyclohexanone were dispersed by means of a sand mill together with 50 parts of 1 mm-diameter glass beads. In this case, a dispersion liquid was prepared so that the average particle size of the resultant dispersed particles was 0.08 μm measured by means of an automatic centrifugal measurement device for particle size (Model: CAPA 700, mfd. by Horiba Seisakusho K.K.). The thus prepared dispersion was applied onto the undercoat layer as formed above, and then dried at 100° C. for 10 min. to form a 0.8 μm-thick charge generation layer.

Then, 10 parts of a hydrazone compound represented by the following formula:

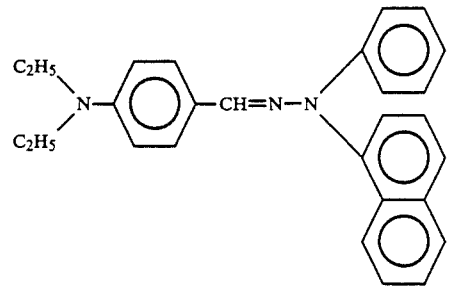

and 15 parts of a styrene-methyl methacrylate copolymer resin (trade name: MS 200, mfd. by Shin-Nichitetsu Kagaku K.K.) were dissolved in 90 parts of toluene to prepare a coating liquid, which was then applied onto the above-mentioned charge generation layer by dip coating. The resultant coating was left standing for 10 min., and thereafter dried under heating at 100° C. for 1 hour to form a 16 μm-thick charge transport layer, whereby a electrophotographic photosensitive member was prepared.

The thus prepared photosensitive member was assembled in a digital-type electrophotographic apparatus (LBP-CX, mfd by Canon K.K.) using reversal development and a 780 nm-laser beam as a light source. By using a negatively chargeable toner as a developer, the resultant images were evaluated under environmental conditions of 35° C. and 85% RH while regulating $V_{DC}$ and Vd as shown in the following Table 2.

The thus obtained results are shown in the following Tables 3 and 4.

TABLE 2

| Regulation condition | $V_{DC}$ (V) | Ve (V) | Vd° (V) | A | Vd (V) |
|---|---|---|---|---|---|
| I (Example 1) | −400 – −600 | −150 | −600 | 0.6 | −600 – −720 |
| II (Comparative | −400 – −600 | −150 | −700 | 0 | −700 (constant) |

TABLE 2-continued

| Regulation condition | $V_{DC}$ (V) | Ve (V) | Vd° (V) | A | Vd (V) |
|---|---|---|---|---|---|
| Example 1) | | | | | |

In the above Table 2, A is a multiplication factor in the following formula:

$$|Vd-Vd^0|=A\times|V_{DC}-V_{DC}^0|,$$

and the voltage values enclosed with circles are those changed in the image regulation.

The thus obtained amounts of reverse fog measured by a Macbeth densitometer, and the number of black spots (fog), i.e., image defects, observed in an area of 10 cm×10 cm are shown in the following Table 3 (Example 1) and Table 4 (Comparative Example 1).

TABLE 3

| Potential Regulation Condition I (Example 1) | | | | | |
|---|---|---|---|---|---|
| Conditions | | | | | |
| Vd (V) | −600 | −630 | −660 | −690 | −720 |
| $V_{DC}$ (V) | −400 | −450 | −500 | −550 | −600 |
| Reverse fog (Macbeth density) | 0.035 | 0.035 | 0.03 | 0.03 | 0.025 |
| Black spot fog (number of image defects/100 cm²) | 0 | 0 | 0 | 0 | 0 |

TABLE 4

| Potential Regulation Condition II (Comparative Example 1) | | | | | |
|---|---|---|---|---|---|
| Conditions | | | | | |
| Vd (V) | −700 | −700 | −700 | −700 | −700 |
| $V_{DC}$ (V) | −400 | −450 | −500 | −550 | −600 |
| Reverse fog (Macbeth density) | 0.06 | 0.05 | 0.04 | 0.03 | 0.025 |
| Black spot fog (number of image defects/100 cm²) | 0 | 0 | 0 | 1 | 4 |

As apparent from the above Tables 3 and 4, in Example 1 (Table 3), the reverse fog was little and no image defect occurred in the whole range of $|V_{DC}|$, because $|Vd|$ was increased in combination with the increase in $|V_{DC}|$.

On the other hand, in Comparative Example 1 (Table 4), the amounts of the reverse fog were considerably large in the region of a relatively small $|V_{DC}|$, and further image defects occurred in the region of a relatively large $|V_{DC}|$, because $|Vd|$ was constant.

EXAMPLES 2 and 3, COMPARATIVE EXAMPLE 2

5 species of photosensitive members (i.e., Samples (A), (B), (C), (D) and (E)) were respectively prepared in the same manner as in Example 1 except that 5 species of dispersions for forming charge generation layers were prepared so that the average particle sizes of the charge-generating substance dispersed in the resultant dispersion were 0.04, 0.06, 0.10, 0.15 and 0.25 μm, respectively.

Further, 5 species of photosensitive members (i.e., Samples (F), (G), (H), (I) and (J)) were respectively prepared in the same manner as described above except that the thicknesses of charge generation layers were 5 μm.

The thus prepared 10 species of photosensitive members were respectively assembled in the electrophotographic apparatus used in Example 1 and the resultant images were evaluated under the same environmental conditions as in Example 1 while regulating $V_{DC}$ and Vd as shown in the following Table 5. The thus obtained results are shown in the following Tables 6, 7 and 8.

TABLE 5

| Regulation condition | $V_{DC}$ | Ve (V) | Vd° (V) | A | Vd (V) |
|---|---|---|---|---|---|
| III (Example 2) | −300 – −500 | −150 | −550 | 1 | −750 – −550 |
| IV (Example 3) | −300 – −500 | −150 | −450 | 1.5 | −750 – −450 |
| V (Comparative Example 2) | −300 – −500 | −150 | −600 | 0 | −600 (constant) |

Incidentally, in the following Tables 6, 7 and 8, the amount of reverse fog is shown only with respect to Sample (A), because no difference in the reverse fog was observed among Samples (A) to (J).

TABLE 6

| Sample | Potential Regulation Condition III (Example 2) | | | | | |
|---|---|---|---|---|---|---|
| | Condition | | | | | |
| | Vd (V) | −550 | −600 | −650 | −700 | −750 |
| | $V_{DC}$ (V) | −300 | −350 | −400 | −450 | −500 |
| (A) | Reverse fog (Macbeth density) | 0.05 | 0.05 | 0.05 | 0.05 | 0.05 |
| (A) | Black spot fog | 0 | 0 | 0 | 0 | 0 |
| (B) | (number of | 0 | 0 | 0 | 0 | 0 |
| (C) | image | 0 | 0 | 0 | 0 | 0 |
| (D) | defects/ | 0 | 0 | 0 | 0 | 0 |
| (E) | 100 cm²) | 0 | 0 | 0 | 0 | 0 |
| (F) | | 0 | 0 | 0 | 0 | 0 |
| (G) | | 0 | 0 | 0 | 0 | 0 |
| (H) | | 0 | 0 | 0 | 0 | 0 |
| (I) | | 0 | 0 | 0 | 0 | 0 |
| (J) | | 0 | 0 | 0 | 0 | 0 |

TABLE 7

| Sample | Potential Regulation Condition IV (Example 3) | | | | | |
|---|---|---|---|---|---|---|
| | Condition | | | | | |
| | Vd (V) | −450 | −525 | −600 | −675 | −750 |
| | $V_{DC}$ (V) | −300 | −350 | −400 | −450 | −500 |
| (A) | Reverse fog (Macbeth density) | 0.03 | 0.035 | 0.035 | 0.04 | 0.05 |

TABLE 7-continued

| Sample | Potential Regulation Condition IV (Example 3) | | | | | |
|---|---|---|---|---|---|---|
| (A) | Black spot fog | 0 | 0 | 0 | 0 | 0 |
| (B) | (number of | 0 | 0 | 0 | 0 | 0 |
| (C) | image | 0 | 0 | 0 | 0 | 0 |
| (D) | defects/ | 0 | 0 | 0 | 0 | 0 |
| (E) | 100 $cm^2$) | 0 | 0 | 0 | 0 | 0 |
| (F) | | 0 | 0 | 0 | 0 | 0 |
| (G) | | 0 | 0 | 0 | 0 | 0 |
| (H) | | 0 | 0 | 0 | 0 | 0 |
| (I) | | 0 | 0 | 0 | 0 | 0 |
| (J) | | 0 | 0 | 0 | 0 | 0 |

TABLE 8

| Sample | Potential Regulation Condition V (Comparative Example 2) | | | | | |
|---|---|---|---|---|---|---|
| | Condition | | | | | |
| | Vd (V) | −600 | −600 | −600 | −600 | −600 |
| | $V_{DC}$ (V) | −300 | −350 | −400 | −450 | −500 |
| (A) | Reverse fog (Macbeth density) | 0.06 | 0.05 | 0.04 | 0.03 | 0.025 |
| (A) | Black spot fog | 0 | 0 | 0 | 0 | 0 |
| (B) | (number of | 0 | 0 | 0 | 0 | 0 |
| (C) | image | 0 | 0 | 0 | 0 | 23 |
| (D) | defects/ | 0 | 0 | 0 | 13 | 40 |
| (E) | 100 $cm^2$) | 0 | 0 | 3 | 35 | 82 |
| (F) | | 0 | 0 | 0 | 0 | 2 |
| (G) | | 0 | 0 | 0 | 1 | 5 |
| (H) | | 0 | 0 | 0 | 3 | 35 |

TABLE 8-continued

| Sample | Potential Regulation Condition V (Comparative Example 2) | | | | |
|---|---|---|---|---|---|
| (I) | 0 | 0 | 1 | 25 | 53 |
| (J) | 0 | 0 | 15 | 45 | 105 |

As shown in the above Table 8, in Comparative Example 2, the amounts of the reverse fog were considerably large in the region of a relatively small $|V_{DC}|$, and further image defects occurred in the region of a relatively large $|V_{DC}|$, with respect to the photosensitive members other than Samples A and B.

On the other hand, in Example 2 (Table 6), reverse fog, while somewhat observed in an amount of 0.05, was constant in the whole range of $|V_{DC}|$, and no image defect occurred in the whole range of $|V_{DC}|$ with respect to all the photosensitive members.

Further, as shown in FIG. 7, Example 3 showed further improvement. More specifically, reverse fog was little in the whole range of $|V_{DC}|$ and no image defect occurred with respect to all the photosensitive members.

EXAMPLE 4, COMPARATIVE EXAMPLE 3

A substrate of an aluminum cylinder having an average diameter of 80 mm was prepared by an extrusion method, and then was subjected to mirror grinding. Further, an undercoat layer was formed on the thus prepared substrate in the same manner as in Example 1.

Then, 1 part of a pigment selected from those represented by the following formulas No. 1 to No. 5:

No. 1

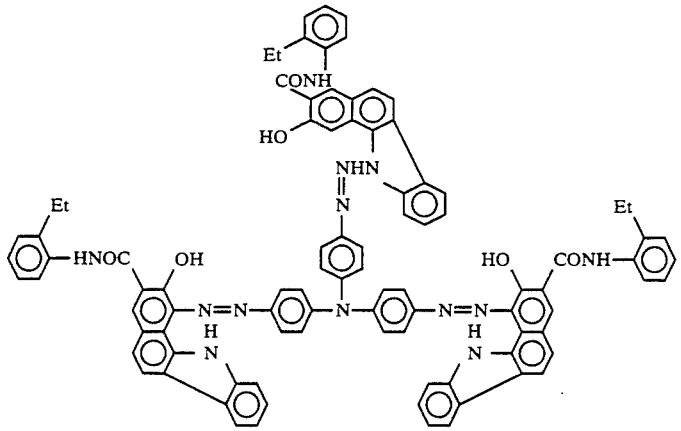

Al—Cl phthalocyanine

No. 2

No. 3

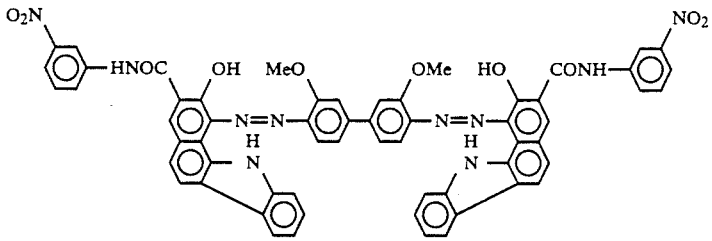

-continued

No. 4

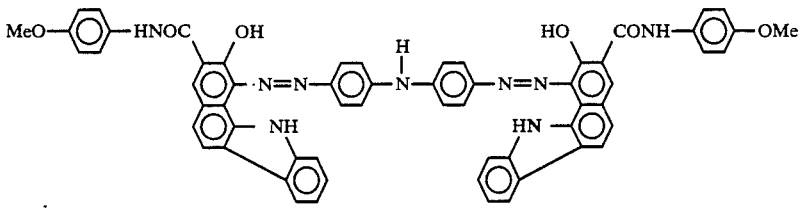

No. 5

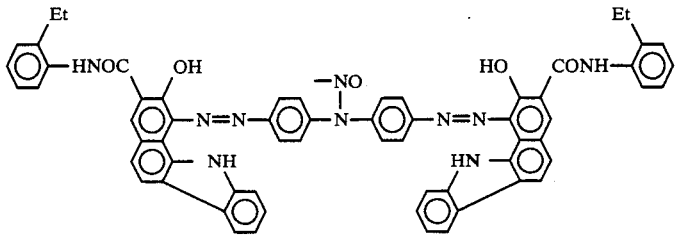

1 part of a polycarbonate resin (trade name: Panlite L-1250, mfd. by Teijin Kasei K.K.) and 10 parts of cyclohexanone were dispersed by means of a sand mill together with 50 parts of 1 mm-diameter glass beads. In this case, 5 species of dispersion liquids were prepared while adjusting the dispersing time so that the average particle size of the dispersed particles were 0.1 mm.

The thus prepared 5 species of dispersion liquids were respectively applied onto the above-mentioned undercoat layer, and dried under heating at 100° C. for 10 min. to form 1.5 μm-thick charge generation layers. Then, charge transport layers in the same manner as in Example 1, thereby to prepare 5 species of photosensitive members (i.e., Samples (K), (L), (M), (N) and (O)) respectively using the above-mentioned charge generating substances No. 1 to No. 5.

The thus prepared 5 species of photosensitive members were respectively assembled in an electrophotographic apparatus (NP-3525, mfd. by Canon K.K.) which had been so modified as to use a reversal development method, and reverse fog and image defects were evaluated under potential regulation conditions as shown in the following Table 9.

TABLE 9

| Potential regulation condition | $V_{DC}$ (V) | Ve (V) | Vd° (V) | A | Vd (V) |
|---|---|---|---|---|---|
| VI (Comparative Example 3) | −200 − −500* | −100 | −600 | 0 | −600 (constant) |
| VII (Example 4) | −200 − −500 | −100 | −300 | 1.5 | −300 − −750 |

In the above Table 9, the voltage values enclosed with circles are those changed in the image regulation.

The thus obtained amount of reverse fog in terms of Macbeth density, and black spot fog in terms of the number of image defects in an area of 10 cm×10 cm were shown in the following Table 10. Incidentally, in the following Table 10, the amount of reverse fog is shown only with respect to Sample (K) because no difference in the reversal fog was observed among Samples (K) to (O).

TABLE 10

| | Sample | | | | | |
|---|---|---|---|---|---|---|
| Potential regulation condition VI (Comparative Example 3) | | Condition | | | | |
| | | Vd (V) | −600 | −600 | −600 | −600 |
| | | $V_{DC}$ (V) | −200 | −300 | −400 | −500 |
| | (K) | Reverse fog (Macbeth density) | 0.065 | 0.06 | 0.035 | 0.02 |
| | (K) | Black soft fog (number of image defects/ 100 cm²) | 0 | 0 | 0 | 72 |
| | (L) | | 0 | 0 | 0 | 8 |
| | (M) | | 0 | 0 | 0 | 20 |
| | (N) | | 0 | 0 | 0 | 59 |
| | (O) | | 0 | 0 | 0 | 38 |
| Potential regulation condition VII (Comparative Example 4) | | Condition | | | | |
| | | Vd (V) | −300 | −450 | −600 | −750 |
| | | $V_{DC}$ (V) | −200 | −300 | −400 | −500 |
| | (K) | Reverse fog (Macbeth density) | 0.02 | 0.025 | 0.035 | 0.04 |
| | (K) | Black soft fog (number of image defects/ 100 cm²) | 0 | 0 | 0 | 0 |
| | (L) | | 0 | 0 | 0 | 0 |
| | (M) | | 0 | 0 | 0 | 0 |
| | (N) | | 0 | 0 | 0 | 0 |

TABLE 10-continued

| Sample | | | | |
|---|---|---|---|---|
| (O) | 0 | 0 | 0 | 0 |

As apparent from the above results of Example 4 in comparison with those of Comparative Example 3, by changing Vd corresponding to the change in $V_{DC}$, there could be effected image regulation by which reverse fog was suppressed to very small amount and the occurrence of black spot fog (i.e., image defect) was completely prevented in the whole regulation range of $V_{DC}$.

EXAMPLE 5

The electrophotographic photosensitive member (J) used in the Examples 2 and 3 was assembled in the electrophotographic apparatus used in Example 1, and $V_{DC}$ and Vd were regulated under the following conditions:

$V_{DC}$: −300 to −500 V,

Ve = −150 V, $Vd^0$ = −400 V, $|Vd - Vd^o| = (|V_{DC} - V_{DC}^o|)^2/200$

The thus obtained amount of reverse fog in terms of Macbeth density, and black spot fog in terms of the number of image defects in an area of 10 cm×10 cm were shown in the following Table 11.

TABLE 11

| Condition | Vd (V) | −400 | −412.5 | −450 | −512.5 | −600 |
|---|---|---|---|---|---|---|
| | $V_{DC}$ (V) | −300 | −350 | −400 | −450 | −500 |
| Example 5 (J) | Reverse fog | 0.03 | 0.03 | 0.035 | 0.035 | 0.05 |
| | Black spot fog (number of image defects/100 $cm^2$) | 0 | 0 | 0 | 0 | 0 |

As apparent from the above results of Example 5, even when the amount of change in $V_{DC}$ was not proportional to that in Vd, by suitably regulating these amounts of change, the amount of reverse fog could be suppressed to a smaller extent than that in Examples 2 and 3.

EXAMPLE 6

An electrophotographic photosensitive member (amorphous silicon photosensitive member) used for an electrophotographic apparatus (NP-9030, mfd. by Canon K.K.) was assembled in an apparatus (NP-9030) which had been so modified that Vd and $V_{DC}$ were variable, and the resultant images were evaluated under environmental conditions of 35° C. and 85% RH, according to an image regulation method as shown in the following Table 12. The thus obtained results are shown in the following Table 12.

TABLE 12

| Image evaluation method | $V_{DC}$ (V) | Ve (V) | VD° (V) | A | Vd (V) |
|---|---|---|---|---|---|
| Comparative Example 4 | 150 − 300 | 50 | 400 | 0 | 400 (constant) |
| Example 6 | 150 − 300 | 50 | 250 | 1 | −250 − −400 |

In the above Table 12, A is a multiplication factor in the following formula:

$|Vd - Vd^o| = A \times |V_{DC} - V_{DC}^o|$, and the voltage values enclosed with circles are those changed in the image regulation.

The thus obtained amounts of reverse fog measured by a Macbeth densitometer are shown in the following Table 13 (Example 6 and Comparative Example 4).

TABLE 13

| | | | | | |
|---|---|---|---|---|---|
| Potential condition | Vd (V) | 400 | 400 | 400 | 400 |
| | $V_{DC}$ (V) | 150 | 200 | 250 | 300 |
| Comparative Example 4 | Reverse fog (Macbeth density) | 0.07 | 0.055 | 0.03 | 0.02 |
| Potential condition | Vd (V) | 250 | 300 | 350 | 400 |
| | $V_{DC}$ (V) | 150 | 200 | 250 | 300 |
| Example 6 | Reverse fog (Macbeth density) | 0.02 | 0.02 | 0.02 | 0.02 |

As apparent from the above results or Example 6 in comparison with those of Comparative Example 4, even when an amorphous silicon photosensitive member was used, by regulating Vd and $V_{DC}$ according to the present invention, reverse fog was suppressed to very small amount in the whole regulation range of $V_{DC}$.

What is claimed is:

1. An electrophotographic apparatus comprising:

a photosensitive member, charging means for providing a surface potential to the surface of the photosensitive member, image exposure means for exposing the photosensitive member to form an electrostatic latent image which comprises an unexposed dark part and an exposed light part, developing means including a developer-carrying member for providing a toner to the light part thereby to develop the latent image with the toner, and bias application means for applying a bias voltage between the developer-carrying member and the photosensitive member surface to control a developing condition; said charging means, image exposure means, and developing means being disposed in this order along the moving direction of the photosensitive member; wherein said photosensitive member has a photosensitive layer which comprises a charge transport layer and a charge generation layer comprising an organic photoconductor dispersed within a binder; said apparatus further comprising image regulation means for charging the surface potential in the dark part (Vd) in association with the change in DC component ($V_{DC}$) of the bias voltage.

2. An apparatus according to claim 1, wherein an increase or decrease in said DC component ($V_{DC}$) corresponds to an increase or decrease in said surface potential (Vd), respectively.

3. An apparatus according to claim 2, wherein a decrease in $V_{DC}$ corresponds to a decrease in Vd.

4. An apparatus according to claim 1, wherein the amount of the change in $V_{DC}$ is proportional to that in Vd.

5. An apparatus according to claim 1, wherein $V_{DC}$ and Vd satisfy the following formula:

$$200\ V \leqq |V_{DC}| \leqq 650\ V,$$

$$100\ V \leqq |V_{DC}^{max} - V_{DC}^{o}| \leqq 300\ V,$$

$$550\ V \leqq |Vd| \leqq 750\ V,$$

$$40\ V \leqq |V_d^{max} - V_d^{o}| \leqq 200\ V,$$

$$100\ V \leqq |Vd - V_{DC}| \leqq 300\ V, \text{ and}$$

$$|Vd - V_{DC}|^{max} - |Vd - V_{DC}|^{min} \leqq 180\ V,$$

wherein $V_{DC}^{max}$ and $V_{DC}^{o}$ respectively represent the maximum and minimum values of $V_{DC}$ in a variation range thereof, $V_d^{max}$ and $V_d^{o}$ respectively represent the maximum and minimum values of Vd in a variation range thereof, and $|Vd - V_{DC}|^{max}$ and $|Vd - V_{DC}|^{min}$ respectively represent the maximum and minimum values of $|Vd - V_{DC}|$.

6. An apparatus according to claim 1, wherein said charge generation layer is formed by application of a dispersion comprising an organic pigment as the organic photoconductor.

7. An apparatus according to claim 6, wherein the average particle size of the organic pigment dispersed in the charge generation layer is 0.07 μm or larger.

8. An apparatus according to claim 6, wherein said charge generation layer has a thickness of 0.1 μm or larger.

9. An image forming method, comprising:

charging a photosensitive member to provide a surface potential thereto, said photosensitive member having a photosensitive layer which comprises a charge transport layer and a charge generation layer comprising an organic photoconductor dispersed within a binder, exposing the photosensitive member imagewise to form therein an electrostatic latent image which comprises an unexposed dark part and an exposed light part, providing a toner from a developer-carrying member to the light part thereby to develop the latent image with the toner;

wherein a bias voltage is applied between the developer-carrying member and the photosensitive member surface to control a developing condition, and the surface potential in the dark part (Vd) is changed in association with the change in DC component ($V_{DC}$) of the bias voltage.

10. A method according to claim 9, wherein an increase or decreases in said DC component ($V_{DC}$) corresponds to an increase or decrease in said surface potential (Vd), respectively.

11. A method according to claim 10, wherein a decrease in $V_{DC}$ corresponds to a decrease in Vd.

12. A method according to claim 9, wherein the amount of the change in $V_{DC}$ is proportional to that in Vd.

13. A method according to claim 9, wherein $V_{DC}$ and Vd satisfy the following formula:

$$200\ V \leqq |V_{DC}| \leqq 650\ V,$$

$$100\ V \leqq |V_{DC}^{max} - V_{DC}^{o}| \leqq 300\ V,$$

$$550\ V \leqq |Vd| \leqq 750V,$$

$$40\ V \leqq |V_d^{max} - V_d^{o}| \leqq 200\ V,$$

$$100\ V \leqq |Vd - V_{DC}| \leqq 300\ V, \text{ and}$$

$$|Vd - V_{DC}|^{max} - |Vd - V_{DC}|^{min} \leqq 180\ V,$$

wherein $V_{DC}^{max}$ and $V_{DC}^{o}$ respectively represent the the maximum and minimum values of Vd in a variation range thereof, and $|Vd - V_{DC}|^{max}$ and $|Vd - V_{DC}|^{min}$ respectively represent the maximum and minimum values of $|Vd - V_{DC}|$.

* * * * *

UNITED STATES PATENT AND TRADEMARK OFFICE

CERTIFICATE OF CORRECTION

PATENT NO. : 4,974,026

DATED : November 27, 1990

INVENTOR(S) : AKIO MARUYAMA

It is certified that error appears in the above-identified patent and that said Letters Patent is hereby corrected as shown below:

Title Page:

AT [57] ABSTRACT

Line 6, "a" should read --an--.

COLUMN 2

Line 19, "$|Vd|>|V_{DC}\{>Ve$," should read --$|Vd|>|V_{DC}|>Ve$,--.

COLUMN 5

Line 62, "vd," should read --Vd,--.

COLUMN 20

Line 26, "or" should read --of--.
Line 63, "charging" should read --changing--.

UNITED STATES PATENT AND TRADEMARK OFFICE

CERTIFICATE OF CORRECTION

PATENT NO. : 4,974,026

DATED : November 27, 1990

INVENTOR(S) : AKIO MARUYAMA

It is certified that error appears in the above-identified patent and that said Letters Patent is hereby corrected as shown below:

COLUMN 22

Line 17, "decreases" should read --decrease--.
Line 38, "the" should read --the maximum and minimum values of $V_{DC}$ in a variation range thereof, $V_d^{max}$ and $V_d^{\circ}$ respectively represent--.

Signed and Sealed this

Twenty-fifth Day of August, 1992

*Attest:*

DOUGLAS B. COMER

*Attesting Officer*

*Acting Commissioner of Patents and Trademarks*